US007446489B2

(12) United States Patent
Jang

(10) Patent No.: US 7,446,489 B2
(45) Date of Patent: Nov. 4, 2008

(54) APPARATUS AND METHOD OF DRIVING LIGHT SOURCE FOR DISPLAY DEVICE

(75) Inventor: Hyeon-Yong Jang, Osan (KR)

(73) Assignee: Samsung Electronics Co., Ltd. (KR)

( * ) Notice: Subject to any disclaimer, the term of this patent is extended or adjusted under 35 U.S.C. 154(b) by 5 days.

(21) Appl. No.: 10/549,353

(22) PCT Filed: Aug. 7, 2003

(86) PCT No.: PCT/KR03/01593

§ 371 (c)(1),
(2), (4) Date: Sep. 14, 2005

(87) PCT Pub. No.: WO2004/082339

PCT Pub. Date: Sep. 23, 2004

(65) Prior Publication Data

US 2006/0170368 A1 Aug. 3, 2006

(30) Foreign Application Priority Data

Mar. 14, 2003 (KR) ..... 10-2003-0016034

(51) Int. Cl.
*H05B 37/02* (2006.01)

(52) U.S. Cl. ..... 315/309; 315/307; 315/118; 345/102

(58) Field of Classification Search ..... 315/118, 315/291, 294, 297, 307–309, 224, 112; 345/102
See application file for complete search history.

(56) References Cited

U.S. PATENT DOCUMENTS 5,233,273 A * 8/1993 Waki et al. ..... 315/224
6,166,491 A * 12/2000 Tsuchiya et al. ..... 315/169.3
6,424,100 B1 7/2002 Kominami et al. ..... 315/307

(Continued)

FOREIGN PATENT DOCUMENTS

EP 0 477 922 A1 4/1992

(Continued)

OTHER PUBLICATIONS

PCT International Preliminary Examination Report for International Application: PCT/KR2003/001593; Date of Completion of REport: Jan. 19, 2006. (All references cited in report are cited above).

(Continued)

*Primary Examiner*—Douglas W. Owens
*Assistant Examiner*—Ephrem Alemu
(74) *Attorney, Agent, or Firm*—Cantor Colburn LLP

(57) ABSTRACT

An apparatus of driving a light source for a display device is provided. The apparatus includes a temperature sensor (940) sensing a temperature and generating an output voltage based on the sensed temperature, a buffer (950) generating an output signal having a state depending on the output voltage of the temperature sensor (940), an oscillator (931) generating an oscillating signal having a frequency depending on the state of the output signal of the buffer, and an inverter (920) performing a switching operation in response to the oscillating signal from the oscillator (931). Therefore, the inverter (920) increases the voltage applied to the light source when the temperature near the light source is lower than a predetermined temperature since the frequency of the oscillating signal is increased.

9 Claims, 5 Drawing Sheets

U.S. PATENT DOCUMENTS

| | | | | |
|---|---|---|---|---|
| 2002/0053886 | A1 | 5/2002 | Hara et al. | 315/307 |
| 2003/0039633 | A1 | 2/2003 | Yu et al. | 424/93.2 |
| 2003/0173910 | A1 * | 9/2003 | Suzuki | 315/291 |

FOREIGN PATENT DOCUMENTS

| | | | |
|---|---|---|---|
| EP | 0 752 805 | A1 | 1/1997 |
| JP | 09102397 | | 4/1997 |
| JP | 11097758 | | 4/1999 |
| JP | 11195496 | | 7/1999 |
| JP | 2000058286 | | 2/2000 |
| JP | 2000150191 | | 5/2000 |
| JP | 2000243586 | | 9/2000 |
| JP | 2001142049 | | 5/2001 |
| KR | 100190967 | | 1/1999 |
| KR | 2020000012220 | | 7/2000 |
| KR | 1020010085279 | | 9/2001 |
| KR | 1020020042492 | | 6/2002 |
| KR | 200292346 | | 10/2002 |

OTHER PUBLICATIONS

PCT International Search Report; PCT/KR2003/001593; Dated: May 7, 2004.

PCT International Preliminary Examination Report for International Application No. PCT/KR 2003/001593; Date of completion: Jan. 19, 2006.

* cited by examiner

APPARATUS AND METHOD OF DRIVING LIGHT SOURCE FOR DISPLAY DEVICE

BACKGROUND OF THE INVENTION (a) Field of the Invention

The present invention relates to an apparatus and a method of driving a light source for a display device.

(b) Description of the Related Art

Display devices used for monitors of computers and television sets include self-emitting displays such as light emitting diodes (LEDs), electroluminescences (ELs), vacuum fluorescent displays (VFDs), field emission displays (FEDs) and plasma panel displays (PDPs) and non-emitting displays such liquid crystal displays (LCDs) requiring light source.

An LCD includes two panels provided with field-generating electrodes and a liquid crystal (LC) layer with dielectric anisotropy interposed therebetween. The field-generating electrodes supplied with electric voltages generate electric field in the liquid crystal layer, and the transmittance of light passing through the panels varies depending on the strength of the applied field, which can be controlled by the applied voltages. Accordingly, desired images are obtained by adjusting the applied voltages.

The light may be emitted from a light source equipped in the LCD or may be natural light. When using the equipped light source, the total brightness of the LCD screen is usually adjusted by regulating the ratio of on and off times of the light source or regulating the current through the light source.

A light device for an LCD, i.e., a backlight unit usually includes a plurality of fluorescent lamps as a light source and an inverter for driving the lamps, which includes a transformer with a boosting voltage typically determined based on the turns ratio. The inverter converts a DC (direct current) input voltage from an external device into an AC (alternating current) voltage, and then applies the voltage boosted by the transformer to the lamps to turn on the lamps and to control the brightness of the lamps in response to a luminance control signal. Furthermore, the inverter detects a voltage related to a total current flowing in the lamps and controls the voltage applied to the lamps on the basis of the detected voltage.

However, since the lamp of the backlight unit has high impedance under the low temperature, the lamp is supplied with a high voltage for stable lighting operation. In particular, much higher voltages are required for initiating the lamp under the low temperature.

Therefore, the design of the inverter of the backlight unit focuses on the low temperature condition or the initiating condition rather than a normally operating state after ignition of the lamp. For this purpose, the turn ratio of the transformer is set to be high, which continuously applies high voltage to the lamp even in the stabilized state to cause unnecessary power consumption and decrease in operation efficiency.

Particularly, the efficient power consumption is very important for a device with a battery having a limited capacity such as a portable computer.

SUMMARY OF THE INVENTION

An apparatus of driving a light device source for a display device is provided, which includes: an inverter applying a voltage to the light device source to be turned on or off the light device; a temperature sensor sensing a temperature and varying generating an output voltage thereof based on a the sensed temperature sensed thereby; and an inverter controller controlling the voltage outputted from the inverter depending based on a state of the output voltage from of the temperature sensor.

The temperature sensor may include a thermistor having a resistance varying depending on the sensed temperature and may further include a resistor connected to the thermistor. At this time, the resistor functions as a voltage divider along with the thermistor.

The apparatus may further include a buffer generating an output signal in a plurality of states determined based on a predetermined voltage and the output voltage of the temperature sensor, and the buffer preferably has a hysterisis characteristic.

Preferably, the inverter controller includes an oscillator generating an oscillating signal having a frequency varying depending on the states of the output signal from the buffer, and the states of the output signal of the buffer may include a first state and a second state, and the first state is "0" level.

The oscillator preferably includes a resistor and a capacitor. The frequency of the oscillating signal from the oscillator increases when the output signal of the buffer is in the first state.

A method of driving a light source for a display device is also provided, which includes: sensing a temperature; generating a first signal based on the sensed temperature; generating a second signal having a plurality of states depending on a magnitude of the first signal; generating a third signal having a frequency depending on the states of the second signal; applying a voltage to the light source; and changing the voltage applied to the light source responsive to the frequency of the third signal.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
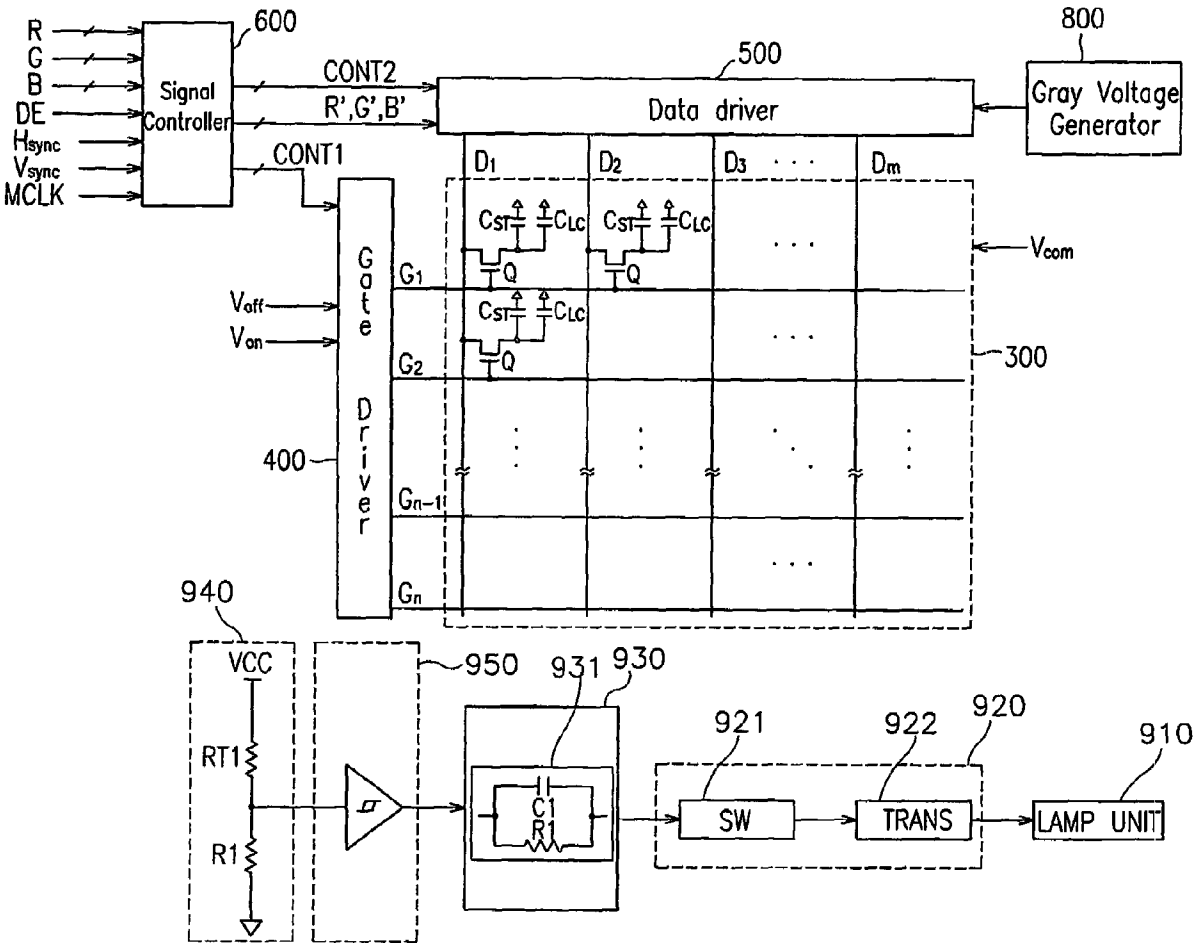
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout In the drawings, the thickness of layers and regions are exaggerated for clarity. Like numerals refer to like elements throughout It will be understood that when an element such as a layer, region or substrate is referred to as being "on" another element, it can be directly on the other element or intervening elements may also be present. In contrast, when an element is referred to as being "directly on" another element, there are no intervening elements present.

Then, apparatus and methods of driving a light source for a display device according to embodiments of the present invention will be described with reference to the drawings.

Figure 2:
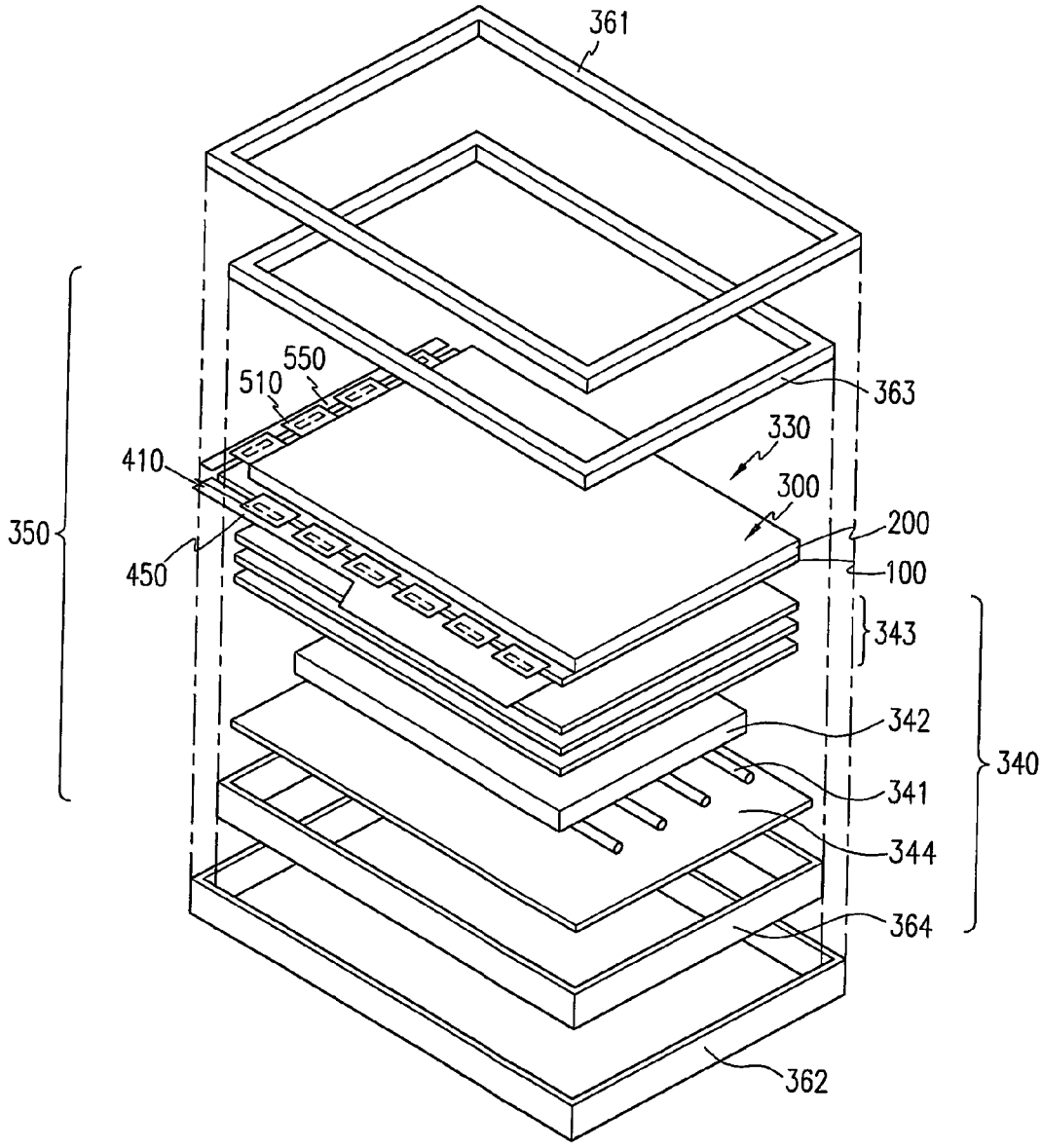
FIG. 2 is an exploded perspective view of an LCD according to an embodiment of the present invention.
Figure 3:
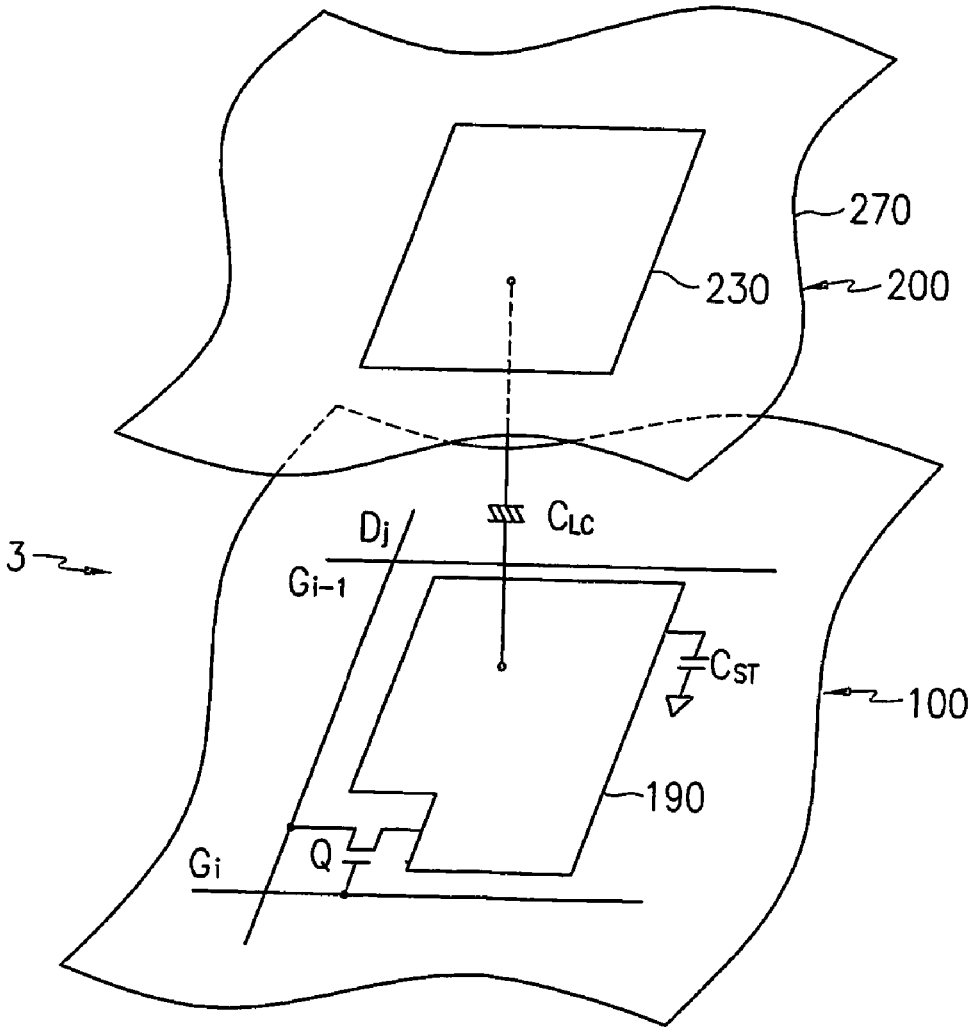
FIG. 3 is an equivalent circuit diagram of a pixel of an LCD according to an embodiment of the present invention.

FIG. 1 is a block diagram of an LCD according to an embodiment of the present invention, FIG. 2 is an exploded perspective view of an LCD according to an embodiment of the present invention, and FIG. 3 is an equivalent circuit diagram of a pixel of an LCD according to an embodiment of the present invention.

Referring to FIG. 1, an LCD according to an embodiment of the present invention includes a LC panel assembly 300, a gate driver 400 and a data driver 500 which are connected to the panel assembly 300, a gray voltage generator 800 connected to the data driver 500, a lamp unit 910 for illuminating the panel assembly 300, an inverter 920 connected to the lamp unit 910, a temperature sensor 940, a buffer 940 connected to the temperature sensor 940, an inverter controller 930 connected between the buffer 940 and the inverter 920, and a signal controller 600 controlling the above elements.

In structural view, the LCD according to an embodiment of the present invention includes a LC module 350 including a display unit 330 and a backlight unit 340, and a pair of front and rear cases 361 and 362, a chassis 363, and a mold frame 364 containing and fixing the LC module 350 as shown in FIG. 2.

The display unit 330 includes the LC panel assembly 300, a plurality of gate flexible printed circuit (FPC) films 410 and a plurality of data FPC films 510 attached to the LC panel assembly 300, and a gate printed circuit board (PCB) 450 and a data PCB 550 attached to the associated FPC films 410 and 510, respectively.

The LC panel assembly 300, in structural view shown in FIGS. 2 and 3, includes a lower panel 100, an upper panel 200 and a liquid crystal layer 3 interposed therebetween while it includes a plurality of display signal lines $G_1$-$G_n$ and $D_1$-$D_m$ and a plurality of pixels connected thereto and arranged substantially in a matrix in circuital view shown in FIGS. 1 and 3.

The display signal lines $G_1$-$G_n$ and $D_1$-$D_m$ are provided on the lower panel 100 and include a plurality of gate lines $G_1$-$G_n$ transmitting gate signals (called scanning signals) and a plurality of data lines $D_1$-$D_m$ transmitting data signals. The gate lines $G_1$-$G_n$ extend substantially in a row direction and are substantially parallel to each other, while the data lines $D_1$-$D_m$ extend substantially in a column direction and are substantially parallel to each other.

Each pixel includes a switching element Q connected to the display signal lines $G_1$-$G_n$ and $D_1$-$D_m$, and an LC capacitor $C_{LC}$ and a storage capacitor $C_{ST}$ that are connected to the switching element Q. The storage capacitor $C_{ST}$ may be omitted if unnecessary.

The switching element Q such as a TFT is provided on the lower panel 100 and has three terminals: a control terminal connected to one of the gate lines $G_1$-$G_n$; an input terminal connected to one of the data lines $D_1$-$D_m$ and an output terminal connected to the LC capacitor $C_{LC}$ and the storage capacitor $C_{ST}$.

The LC capacitor $C_{LC}$ includes a pixel electrode 190 on the lower panel 100, a common electrode 270 on the upper panel 200, and the LC layer 3 as a dielectric between the electrodes 190 and 270. The pixel electrode 190 is connected to the switching element Q, and the common electrode 270 covers the entire surface of the upper panel 100 and is supplied with a common voltage Vcom. Alternatively, both the pixel electrode 190 and the common electrode 270, which have shapes of bars or stripes, are provided on the lower panel 100.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel represent its own color by providing one of a plurality of red, green and blue color filters 230 in an area occupied by the pixel electrode 190. The color filter 230 shown in FIG. 3 is provided in the corresponding area of the upper panel 200. Alternatively, the color filter 230 is provided on or under the pixel electrode 190 on the lower panel 100.

Referring to FIG. 2, the backlight unit 340 includes 340 includes a plurality of lamps 341 disposed behind the LC panel assembly 300, a light guide 342 and a plurality of optical sheets 343 disposed between the panel assembly 300 and the lamps 341 and guiding and diffusing light from the lamps 341 to the panel assembly 300, and a reflector 344 disposed under the lamps 341 and reflecting the light from the lamps 341 toward the panel assembly 300.

The lamps 341 preferably include fluorescent lamps such as CCFL (cold cathode fluorescent lamp) and EEFL (external electrode fluorescent lamp). An LED is another example of the lamp 341.

The inverter 920, the temperature sensor 940, the buffer 950 and the inverter controller 930 may be mounted on a stand-alone inverter PCB (not shown) or mounted on the gate PCB 450 or the data PCB 550.

A pair of polarizers (not shown) polarizing the light from the lamps 341 are attached on the outer surfaces of the panels 100 and 200 of the panel assembly 300.

Referring to FIGS. 1 and 2, the gray voltage generator 800 generates two sets of a plurality of gray voltages related to the transmittance of the pixels and is provided on the data PCB 550. The gray voltages in one set have a positive polarity with respect to the common voltage Vcom, while those in the other set have a negative polarity with respect to the common voltage Vcom.

The gate driver 400 preferably includes a plurality of integrated circuit (IC) chips mounted on the respective gate FPC films 410. The gate driver 400 is connected to the gate lines $G_1$-$G_n$ of the panel assembly 300 and synthesizes the gate-on voltage Von and the gate off voltage Voff from the driving voltage generator 700 to generate gate signals for application to the gate lines $G_1$-$G_n$.

The data driver 500 preferably includes a plurality of IC chips mounted on the respective data FPC films 510. The data driver 500 is connected to the data lines $D_1$-$D_m$ of the panel assembly 300 and applies data voltages selected from the gray voltages supplied from the gray voltage generator 800 to the data lines $D_1$-$D_m$.

According to another embodiment of the present invention, the IC chips of the gate driver 400 and/or the data driver 500 are mounted on the lower panel 100, while one or both of the drivers 400 and 500 are incorporated along with other elements into the lower panel 100 according to still another embodiment. The gate PCB 450 and/or the gate FPC films 410 may be omitted in both cases.

The signal controller 600 controlling the drivers 400 and 500, etc. is provided on the data PCB 550 or the gate PCB 450.

Now, the operation of the LCD will be described in detail.

The signal controller 600 is supplied with RGB image signals R, G and B and input control signals controlling the display thereof such as a vertical synchronization signal Vsync, a horizontal synchronization signal Hsync, a main clock MCLK, and a data enable signal DE, from an external graphic controller (not shown). After generating gate control signals CONT1 and data control signals CONT2 and processing the image signals R, G and B suitable for the operation of the panel assembly 300 on the basis of the input control signals and the input image signals R, G and B, the signal controller 600 provides the gate control signals CONT1 for the gate driver 400, and the processed image signals R', G' and B' and the data control signals CONT2 for the data driver 500.

The gate control signals CONT1 include a vertical synchronization start signal STV for informing of start of a frame, a gate clock signal CPV for controlling the output time of the gate-on voltage Von, and an output enable signal OE for defining the width of the gate-on voltage Von. The data control signals CONT2 include a horizontal synchronization start signal STH for informing of start of a horizontal period, a load signal LOAD or TP for instructing to apply the appropriate data voltages to the data lines $D_1$-$D_m$ an inversion control signal RVS for reversing the polarity of the data voltages (with respect to the common voltage Vcom) and a data clock signal HCLK.

The data driver 500 receives a packet of the image data R', G' and B' for a pixel row from the signal controller 600 and converts the image data R', G' and B' into the analogue data voltages selected from the gray voltages supplied from the gray voltage generator 800 in response to the data control signals CONT2 from the signal controller 600.

Responsive to the gate control signals CONT1 from the signals controller 600, the gate driver 400 applies the gate-on voltage Von to the gate line $G_1$-$G_n$, thereby turning on the switching elements Q connected thereto.

The data driver 500 applies the data voltages to the corresponding data lines $D_1$-$D_m$ for a turn-on time of the switching elements Q (which is called "one horizontal period" or "1H" and equals to one periods of the horizontal synchronization signal Hsync, the data enable signal DE, and the gate clock signal CPV). Then, the data voltages in turn are supplied to the corresponding pixels via the turned-on switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on the magnitude of the pixel voltage and the orientations determine the polarization of light passing through the LC capacitor $C_{LC}$. The polarizers convert the light polarization into the light transmittance.

By repeating this procedure, all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

The temperature sensor 940 generates a temperature sensing signal with a magnitude varying depending on the circumferential temperature, and the buffer 950 amplifies and output the temperature sensing signal.

The inverter 920 converts a DC voltage into an AC voltage, boosts the AC voltage and applies the boosted AC voltage to the lamp unit 910 in response to an inverter control signal from the inverter controller 930.

The inverter controller 930 varies the frequency of the inverter control signal depending on the temperature sensing signal provided from the temperature sensor 940 via the buffer 950.

The operation of the inverter controller 930 controlling the inverter 920 based on the temperature sensing signal from the temperature sensor 940 will be described in detail with reference to FIGS. 1, 4 and 5A to 5C.

Figure 4:
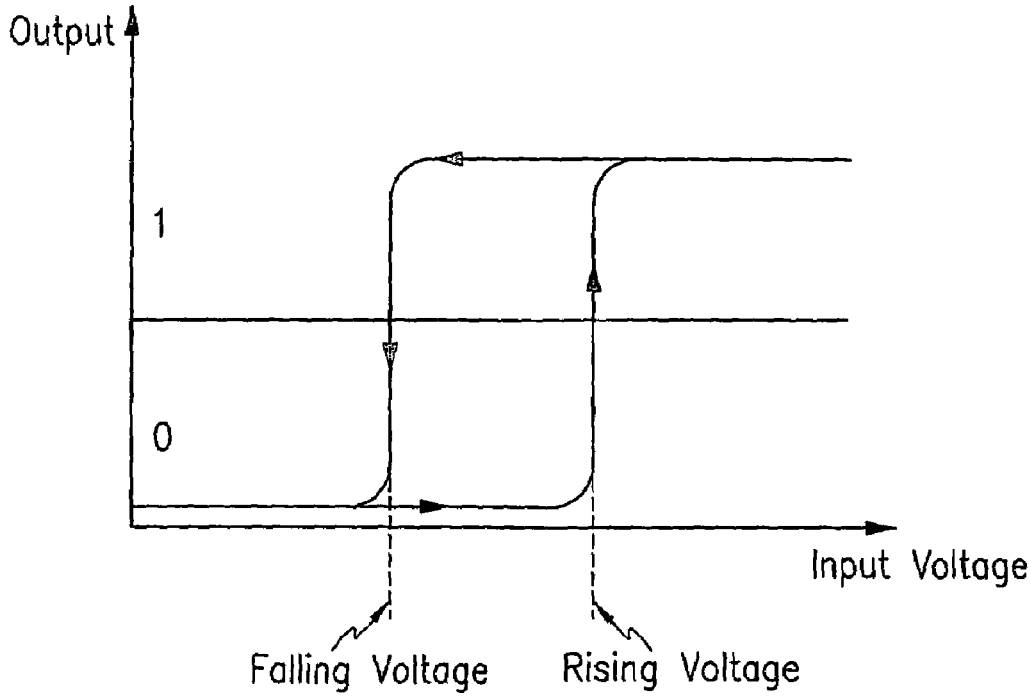
FIG. 4 is a graph illustrating an output signal of a buffer as function of an input voltage according to an embodiment of the present invention.

FIG. 4 is a graph showing an output signal of the buffer according to an embodiment of the present invention as function of an input voltage and FIGS. 5A to 5C are graphs showing a temperature, an output signal of the temperature sensor and an output signal of the buffer as function of time according to an embodiment of the present invention.

As shown in FIG. 1, the temperature sensor 940 includes a voltage divider connected between a supply voltage VCC and a ground and including a thermistor RT1 and a resistor R1 connected in series. The thermistor RT1 according to an embodiment of the present invention has a resistance which decreases as the temperature increases and may be mounted on the inverter PCB or near the lamp unit 910. However, it is apparent that the operation characteristics or the mounting positions of the thermistor RT1 may be changed.

The buffer 950 includes a Schmitt trigger circuit and generates a square wave having a level depending on the temperature sensing signal from the temperature sensor 940.

The inverter controller 930 includes an oscillator 931 having a resister R1 and a capacitor C1 connected in parallel. However, the oscillator 930 may include other elements.

The inverter 920 includes a switching unit 921 and a transformer 922 connected to the switching unit 921.

Now, operations of the above elements will be described.

The temperature sensor 940 divides the supply voltage VCC by the voltage divider including the thermistor RT1 and the resistor R1 and output the divided voltage. The thermistor RT1 has the resistance depending on the temperature at its mounting position.

The resistance of the thermistor RT1 according to this embodiment is inversely proportional to the sensed temperature. Accordingly, the resistance of the thermistor RT1 decreases when the sensed temperature increases, while the resistance of the thermistor RT1 increases when the sensed temperature decreases.

Since the resistance of the thermistor RT1 is inversely proportional to the sensed temperature, the magnitude of the output voltage from the temperature sensor 940 is in proportion to the sensed temperature. That is, the magnitude of the output voltage from the temperature sensor 940 increases as the sensed temperature becomes high, while the magnitude decreases as the sensed temperature becomes low.

According to another embodiment of the present invention, the thermistor RT1 has a resistance in proportion to the sensed temperature.

If the temperature is less than a predetermined temperature under the condition such as the ignition of the lamp unit 910, the resistance of the thermistor RT1 is larger than a predetermined value. Accordingly, the output voltage from the temperature sensor 940 is less than a predetermined voltage. After ignition of the lamp unit 910, the temperature of the lamp unit 910 or the inverter PCB is gradually increased and reaches to the predetermined temperature. The resistance of the thermistor RT1 becomes lower than the predetermined value if the temperature becomes higher than the predetermined temperature and then the output voltage of the temperature sensor 940 becomes higher than the predetermined voltage.

The output voltage of the temperature sensor 940 based on the sensed temperature is applied to the buffer 950. The buffer 950 generates a signal with a "0" state (low level) or a "1" state (high level) depending on the output voltage from the temperature sensor 940. That is, the signal generated by the buffer 950 is in the "1" state if the output voltage of the temperature sensor 940 is larger than the predetermined voltage, while it is in the "0" state if the output voltage of the temperature sensor 940 is less than the predetermined voltage. The signal of the buffer 950 is then applied to the oscillator 931 of the inverter controller 930.

The oscillator 931 generates an oscillating signal having a frequency, which decreases if the signal from the buffer 950 is in the "1" state while increases if the signal from the buffer 950 is in the "0" state in accordance with the change of the RC time constant. On initial lighting or low-temperature lighting of the backlight unit, the output voltage of the inverter 920 applied to the lamp unit 910 is preferably high. However, when the backlight unit is in a normal state, it is preferable that the power efficiency of the inverter 920 is increased. According to the above characteristic, the oscillator 931 can generate an oscillating frequency either to increase the output voltage of the inverter 920 or to increase the power efficiency of the inverter 920 in accordance with the state of the signal from the buffer 950.

The switching unit 921 of the inverter 920 is supplied with the oscillating signal with the frequency determined by the state of the signal applied to the oscillator 931 of the inverter controller 930.

The switching unit 921 is turned on or off responsive to the oscillating signal from the oscillator 931 and converts a DC voltage from an external device into an AC voltage for application to the transformer 922. At this time, the frequency of the AC voltage is affected by tuning on and off of the switching unit 921, and the voltage from the transformer 922 to be applied to the lamp unit 910 becomes larger as the oscillating frequency becomes large.

As described above, since the frequency of the signal applied to the transformer 922 of the inverter 920 is increased during the initial lighting and the low-temperature lighting, the voltage applied to the lamp unit 910 is higher than that applied under the stable operation and thus the lighting deterioration of the lamp unit 910 is reduced.

The buffer 950 according to an embodiment of the present invention has a hysterisis characteristic shown in FIG. 4. The magnitude of the input voltage for converting an output signal from the "0" state into the "1" state is different from that for converting the output signal from the "1" state into the "0" state. In an example of the present invention, the buffer 950 changes the state of the output signal from "0" to "1" when the input voltage is increased to be larger than about 3.0V, while the buffer 950 changes the state of the output signal from "1" to "0" when the input voltage is decreased to be less than about 2.0V.

The above-described characteristic of the buffer 950 prevents the frequent change of the output signal state of the oscillator 931 due to the fine temperature variations to stabilize the operation of the inverter 920.

Figure 5:
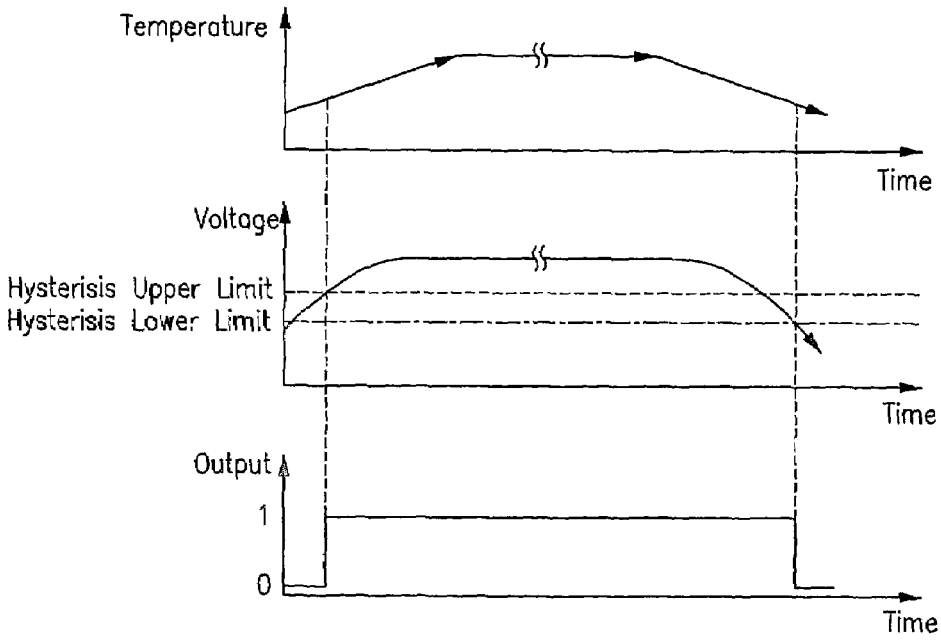
FIG. 5 is graphs respectively illustrating a temperature, an output signal of a temperature sensor, and an output signal of a buffer as function of time according to an embodiment of the present invention.

The first graph of FIG. 5 is a graph illustrating temperature changes with time, and the second and the third graph of FIG. 5 are graphs illustrating the output signals of the temperature sensor 940 and the buffer 950 as function of time.

As shown in the first graph of FIG. 5, when the temperature is gradually increased to reach a predetermined temperature, stays at the temperature for a time, and then is decreased with the passage of time, the output voltage of the temperature sensor 940 is gradually increased, maintains a predetermined voltage, and decreased responsive to the temperature changes as shown in the second graph of FIG. 5. If the output voltage of the temperature sensor 940 becomes larger than the hysterisis upper limit voltage, the output signal of the buffer 950 turns into the "1" state and maintains in the "1" state. However, if the output voltage of the temperature sensor 940 becomes less than the hysterisis lower limit voltage, the buffer 950 changes the signal state from "1" into "0'."

According to this embodiment of the present invention, since the magnitude of the voltage applied to the lamp unit is adjusted based on the vicinity temperature, the lamp unit is stabilized without lighting failure under the initial lighting and the low-temperature lighting and the reliability of the backlight unit is increased. Furthermore, when the operation of the lamp unit is stable, the voltage applied to the lamp unit is decreased to prevent non-efficiency of the inverter due to over power consumption.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An apparatus of driving a light source for a display device, the apparatus comprising:

an inverter applying a voltage to the light source to be turned on or off;

a temperature sensor sensing a temperature and generating a first signal based on the sensed temperature;

a buffer generating a second signal based on the first signal from the temperature sensor and providing the second signal for the inverter controller; and an inverter controller which generates a control signal for controlling the inverter depending on the second signal of the buffer, wherein the voltage applied to the light source is increased based on the control signal, the second signal is a square wave having a first level and a second level, and the second signal is at the first level when the sensed temperature is higher than a predetermined temperature and the second signal is at the second level when the sensed temperature is lower than a predetermined temperature.

2. The apparatus of claim 1, wherein the buffer has a hysterisis characteristic.

3. The apparatus of claim 1, wherein the temperature sensor comprises a thermistor having a resistance varying depending on the sensed temperature.

4. The apparatus of claim 3, wherein the temperature sensor further comprises a resistor connected to the thermistor and the resistor functions as a voltage divider along with the thermistor.

5. The apparatus of claim 1, wherein the inverter controller comprises an oscillator generating an oscillating signal having a frequency varying depending on the second signal from the buffer as the control signal.

6. The apparatus of claim 5, wherein the second level has a value of 0, and the first level has a value of 1.

7. The apparatus of claim 6, wherein the oscillator comprises a resistor and a capacitor connected in parallel, and the frequency of the oscillating signal generated by the oscillator increases when the second signal generated by the buffer is in the first state.

8. A method of driving a light source for a display device, the method comprising:

sensing a temperature;

generating a first signal based on the sensed temperature;

generating a second signal on the basis of the first signal;

generating a third signal having a frequency depending on the second signal;

applying a voltage to the light source; and changing the voltage applied to the light source responsive to the frequency of the third signal, the second signal is a square wave having a first level and a second level, and the second signal is at the first level when the sensed temperature is higher than a predetermined temperature and the second signal is at the second level when the sensed temperature is lower than a predetermined temperature.

9. The method of claim 8, wherein the second level has a value of 0, and the first level has a value of 1.

* * * * *